US008653924B2

(12) United States Patent
Kobayashi et al.

(10) Patent No.: US 8,653,924 B2
(45) Date of Patent: Feb. 18, 2014

(54) REACTOR

(75) Inventors: Masaru Kobayashi, Chiyoda-ku (JP); Takao Mitsui, Chiyoda-ku (JP); Matahiko Ikeda, Chiyoda-ku (JP); Naoki Moritake, Chiyoda-ku (JP); Hirotoshi Maekawa, Chiyoda-ku (JP); Ryuichi Ishii, Chiyoda-ku (JP); Kenji Matsuda, Chiyoda-ku (JP); Toshinori Yamane, Chiyoda (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/288,176

(22) Filed: Nov. 3, 2011

(65) Prior Publication Data

US 2012/0139684 A1 Jun. 7, 2012

(30) Foreign Application Priority Data

Dec. 2, 2010 (JP) ..... 2010-268894

(51) Int. Cl.
*H01F 27/06* (2006.01)
*H01F 27/02* (2006.01)
*H01F 27/30* (2006.01)

(52) U.S. Cl.
USPC ..... 336/65; 336/67; 336/90; 336/92; 336/96; 336/196; 336/197; 336/199

(58) Field of Classification Search
USPC ..... 336/65, 67, 90, 92, 96, 196, 197, 199
See application file for complete search history.

(56) References Cited

U.S. PATENT DOCUMENTS

| | | | | |
|---|---|---|---|---|
| 7,782,168 | B2 * | 8/2010 | Nakatsu et al. | 336/221 |
| 2010/0026434 | A1 * | 2/2010 | Okamoto et al. | 336/65 |
| 2010/0102912 | A1 * | 4/2010 | Suzuki et al. | 336/65 |
| 2010/0321145 | A1 | 12/2010 | Kaoru et al. | |
| 2012/0032771 | A1 | 2/2012 | Hattori et al. | |

FOREIGN PATENT DOCUMENTS

| | | | | |
|---|---|---|---|---|
| DE | 11 2008 000 364 | T5 | | 3/2010 |
| JP | 04-127406 | A | | 4/1992 |
| JP | 2000-340428 | A | | 12/2000 |
| JP | 2008021688 | A | * | 1/2008 |

(Continued)

OTHER PUBLICATIONS

Japanese Office Action, Patent Application No. 2010-268894, issued Nov. 6, 2012, Partial Translation.

(Continued)

*Primary Examiner* — Tsz Chan
(74) *Attorney, Agent, or Firm* — Sughrue Mion, PLLC

(57) ABSTRACT

The invention provides a reactor to be built in a power converter. In the reactor, an induction component composed of a coil being a winding of a conductor wire, a core in which interior a magnetic path is formed and an insulation bobbin positioning and engaging a wire wound part of the coil is housed in a case to be soaked with a mold resin. Inner bottom face of the case has a plurality of surfaces having not less than two different heights letting the outside bottom of the case a reference surface, and the lower end face of the core is in contact with any of the case inner bottom surfaces excluding the lowest inner bottom surface. As a result, the reactor is suitable for on-vehicle applications to achieve reduced article variation as well as a longer service life, a shorter operation time and decreased cost.

18 Claims, 8 Drawing Sheets

(a) (b)

(56) References Cited

FOREIGN PATENT DOCUMENTS

| | | | | |
|---|---|---|---|---|
| JP | 2008-198870 | A | | 8/2008 |
| JP | 2008198870 | A | * | 8/2008 |
| JP | 2008-210976 | A | | 9/2008 |
| JP | 2009-099596 | A | | 5/2009 |
| JP | 2010-147130 | A | | 7/2010 |
| JP | 2010147130 | A | * | 7/2010 |
| WO | 2006/016554 | A1 | | 2/2006 |

OTHER PUBLICATIONS

German Office Action, issued Aug. 16, 2013, in counterpart Patent Application No. 10 2011 086 940.9, along with an English translation thereof English translation.

* cited by examiner

REACTOR

FIELD OF THE INVENTION

The present invention relates to a reactor for use in a power converter and, in particular, to a reactor suitable for on-vehicle applications that achieves reduced variation in performance, shorter operation time and decreased cost, by easy positioning and improving coming round performance of injection of a mold resin.

DESCRIPTION OF THE RELATED ART

Conventionally, a reactor has been used as a part of a power converter and is for use in, for example, a circuit part of a DC/DC voltage converter as an energy charge/discharge element. At the operation of a power converter, heat is generated when a coil of the reactor is energized. To allow this heat to transfer to the outside, an arrangement is employed such that heat is transferred to a sealing mold resin formed with respect to a case housing a reactor, and the heat is further radiated to the outside via a radiator plate.

As an example of this reactor for use in a power converter to be mounted on an electric power train for automobiles, for example, the Japanese Patent Publication (unexamined) No. 99596/2009 discloses a reactor.

In the reactor disclosed in the Japanese Patent Publication (unexamined) No. 99596/2009, a reactor body is housed in a case and an insulating mold resin such as epoxy resin, urethane resin or silicone resin is charged. As the result, insulation properties between the coil and the case of the reactor and between the coil and the core thereof is ensured by the mold resin, and heat radiation is improved with respect to the rise of temperature due to heat that the reactor body generates, thus the degree of temperature rise is suppressed.

In the case of a reactor for on-vehicle application, due to strict requirements as to the space in which the reactor can be located and the weight, it needs to be small-sized and light weighted. Thus, as compared with a reactor for other applications, it is designed so as to obtain higher power density and higher current density.

In the case, however, of higher power density, despite its small sizes, the loss that the reactor body generates is not reduced and the temperature rise in the interior of the reactor tends to be larger.

Hence, an enameled wire in which an insulating polymeric material such as polyimide or polyamide-imide is coated on the surface layer of a copper wire, is employed as wire conductor of a coil employs. In case of occurrence of high temperature of the coil, a molecular chain of polymeric materials that is applied onto the surface of the copper wire is decomposed and thus insulation properties of an enamel coating comes to be deteriorated, leading to the short circuit in a current path between turns of a conductive wire wound part of a coil, and characteristics of an expected inductance cannot be maintained but reduced. In addition, a problem exits in that insulation properties having to be present between a peripheral member and a coil is lost, causing such difficulties as increase of leak current and dielectric breakdown, and eventually it becomes hard to obtain a desired service life.

In the case that a reactor is for use in a power converter to be mounted on automobiles, the reactor and a housing in which a power converter is housed are rigidly fixed to an automobile body using a metal fastening member. Whereas, in the case that an electric system to energize a coil is at a voltage not less than 50V, to prevent a passenger or mechanic of automobiles from easily touching it and suffering from an electric shock, such considerations are taken as to have electric insulation properties between the electric system and the automobile body. That is, core and case have to be electrically insulated from the coil of the reactor, and the inability to maintain such insulation properties means a fault of the reactor.

Moreover, in addition to the above-mentioned electric insulation to be ensured, a problem exists in that the electric resistance of the wire conductor is increased based on the temperature coefficient of copper at high temperatures, and a joule loss at the coil portion is increased resulting in reduction of efficiency of the reactor.

Therefore, alumina ($Al_2O_3$), aluminum hydroxide ($AlOH_3$) and the like having insulation properties and a thermal conductivity higher than that of the resin of base material is mixed in a mold resin to be injected in the case. Thus, it is designed to ensure insulation properties between the coil and the core as well as the coil and the case and to improve heat conduction in a path leading to the outside of the case via the mold resin thereby increasing heat radiation.

In the above-mentioned conventional reactor, however, since the core or the coil of the reactor body is located in high density in the case, a problem exits in that a mold resin is not charged stably, and defective insulation or variation (unevenness) in heat radiation of each individual product is likely to occur. Furthermore, another problem exists in a longer time needed to charge the mold resin and thus higher manufacturing cost.

That is, when a filler material is mixed in the mold resin, it is certain that heat conduction is improved, but the viscosity of the mold resin is increased to be hard to spread into a reactor body.

Accordingly, in a reactor constructed in small sizes, although the distance between the wire wound part of the coil that acts mainly as a heat-generated point and the case is desired to be shorter, there arises a further problem that the mold resin is not sufficiently spread to this part depending on the viscosity, and insulation properties in accordance with a desired service life cannot be obtained.

In addition, on the occasion of housing a reactor body in the case, in case of no reliable positioning, since the distance between the wire wound part of the coil and the case varies for each individual product, it comes to be difficult to cause a mold resin to spread with sufficient stability to suppress variation in insulation and variation in heat radiation.

In the charging process of a mold resin, at the same time that the mold resin itself, reactor body and case are heated and the viscosity of the mold resin is made to be less than a predetermined value to keep successful spread of the mold resin into a reactor, it is necessary to set the work area in the resin charging to be in low-pressure environments close to a vacuum state to remove air bubbles mixing in the mold resin.

When viscosity of the mold resin is increased by mixing the filler material therein, the change in viscosity affected by temperature change becomes larger than is conventional, and therefore variation of charging the mold resin is more likely to occur. Owing to charge variation, in case that air bubbles come in the mold resin or the mold resin cannot spread into the space in which the mold resin has to be spread, insulation cannot be obtained at this portion eventually resulting in defective insulation. Furthermore, owing to expansion or contraction due to repeated high temperatures or low temperatures at the time of operation or non-operation of the reactor, there occurs such a failure that a contact state at the boundary between the mod resin and members such as core, case and coil comes to be unintended thus not to obtain a predetermined heat radiation.

To avoid such variation in mold resin charging, it may be an idea that the work area is returned to atmospheric pressure environments from low-pressure environments to set the mold resin, and thereafter the work area is returned again to low-pressure environments to repeat the charging operation of the mold resin. However, there arises a still further problem that the resin charging work should be made at plural times and the air pressure of the work area should be changed between low-pressure environments and atmospheric pressure environments thus requiring a longer time eventually resulting in higher manufacturing cost.

SUMMARY OF THE INVENTION

The present invention was made to solve the above-discussed problems and has an object of providing a small-sized reactor for use in a power converter for an electric power train for automobiles, the reactor enabling reduced charge variation of mold resin, a shorter manufacturing time and low cost, as well as improved heat radiation and a longer service life.

To accomplish the above-mentioned problems, a reactor according to the invention includes an induction component composed of a coil being a winding of a conductor wire, a core in the interior of which a magnetic path is formed and an insulation bobbin positioning and engaging a wire wound part of the coil is housed in a case to be soaked with a mold resin, and in which inner bottom face of the case has a plurality of surfaces having not less than two different heights letting the outside bottom of the case a reference surface, and the lower end face of the core is in contact with any of the surfaces of the inner bottom faces excluding the lowest inner bottom surface.

According to the reactor of the invention, due to such a construction that the inner bottom face of the case acting to house an induction component body has a plurality of surfaces having not less than two different heights, and the lower end face of the core is in contact with any of the above-mentioned surfaces of the inner bottom excluding the lowest inner bottom surface, even in the case that a mold resin, in which a filler material is mixed to improve heat conduction and of which viscosity is increased, is charged in a reactor of small sizes and of a high power density, coming round performance of the mold resin is improved, and positioning of the induction component on the occasion of housing it in the case and the insulation between the coil and case are made reliable, thus enable to reduce variation in resin charging.

Moreover, a shorter manufacturing time and lower manufacturing cost can be achieved, additionally heat radiation is improved to suppress an operation temperature difference at the time of operation and non-operation of the reactor, and the degree of expansion or contraction is decreased thus enabling to prevent cracks from being generated in the mold resin resulting in defective insulation, as well as it can be prevented that the joule loss of a coil is increased resulting in reduced efficiency.

Consequently, it becomes possible to obtain a reactor suitable for use in a power converter for a power train of electric vehicles such as hybrid cars or electric cars required to have high fuel consumption.

The foregoing and other objects, features, aspects and advantages of the present invention will become more apparent from the following detailed description of the present invention when taken in conjunction with the accompanying drawings.

DETAILED DESCRIPTION OF THE INVENTION

A reactor according to a preferred embodiment of the present invention is hereinafter described referring to the accompanying FIGS. 1 to 11.

Embodiment 1.

Figure 1:
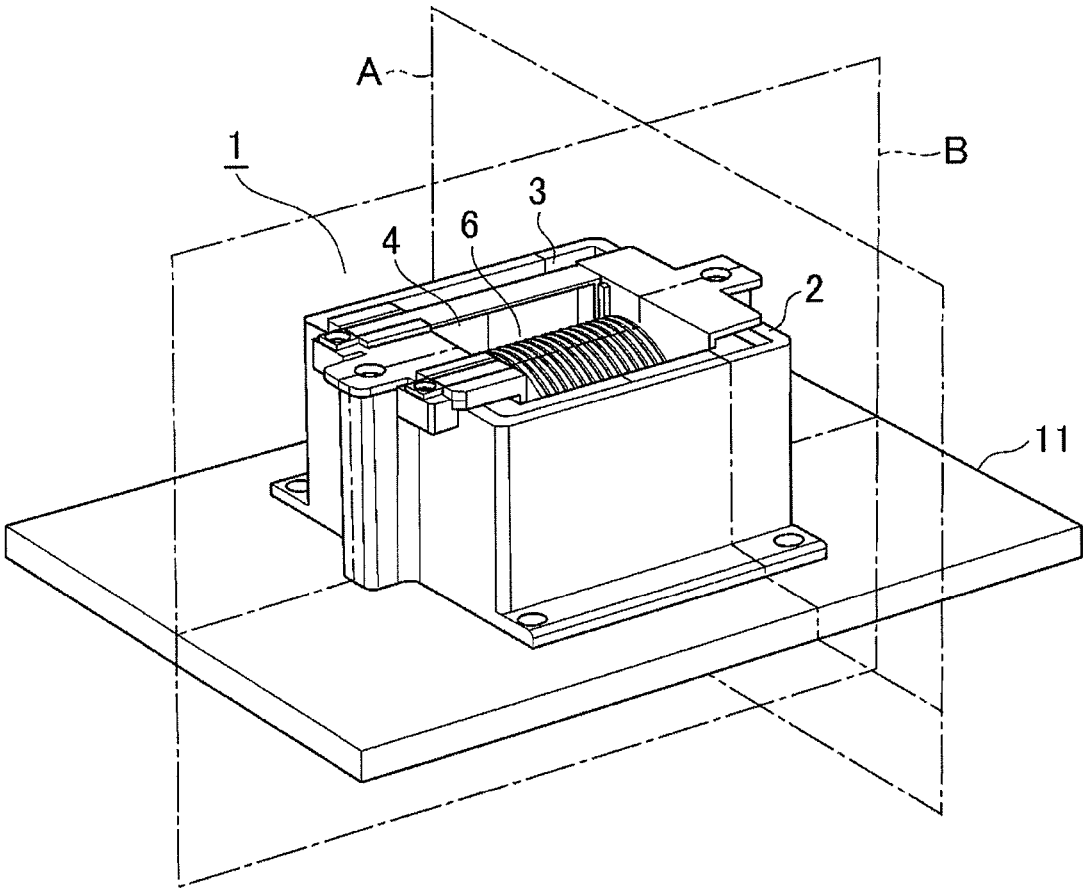
FIG. 1 is a perspective view illustrating a reactor according to a first preferred embodiment of the present invention.
Figure 2:
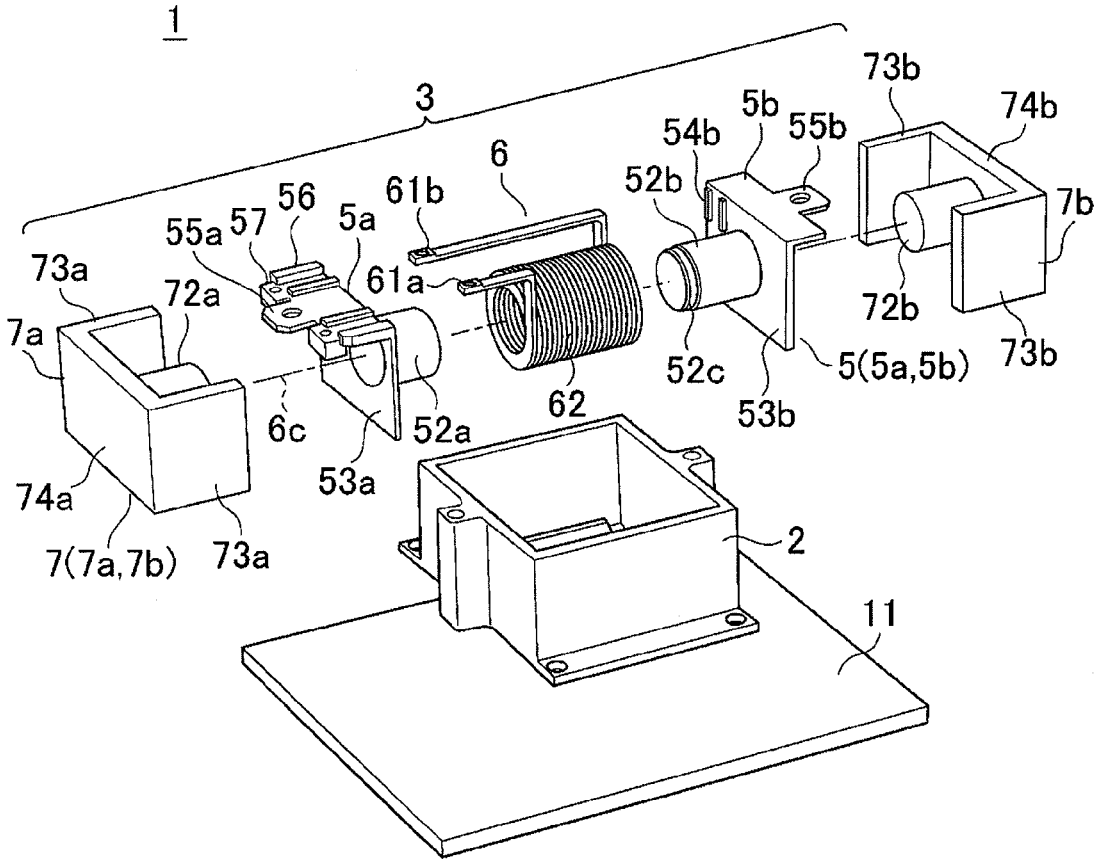
FIG. 2 is an exploded perspective view illustrating exploded components of the reactor illustrated in FIG. 1.

FIG. 1 is a perspective view illustrating a reactor according to a first embodiment of the invention, and FIG. 2 is an exploded perspective view illustrating exploded components of this reactor. Incidentally, the same reference numerals indicate the same or like parts throughout the drawings.

As is illustrated, a reactor 1 includes a case 2, an induction component 3 housed in this case 2 and a mold resin immersing the induction component 3 in the case 2. Furthermore, the induction component 3 is an assembly of separated insulation bobbins 5*a* and 5*b*, a coil 6 and separated core members 7*a* and 7*b*. Incidentally, the core members 7*a* and 7*b* are hereinafter simply referred to as a core.

In addition, between the underside of a wound circumference of a wire wound part 62 of the coil 6 and the inner bottom of the case 2, an insulating member 8 of a thin plate is interposed. The illustration of the insulating member 8, however, is omitted in FIG. 2.

The insulation bobbins 5*a*, 5*b* are component parts each being made of molded plastic such as PPS (Poly Phenylene Sulfide) or PBT (PolyButylene Terphthalate), and have electric insulation properties.

Incidentally, in FIG. 1, the mold resin 4 is shown clear for convenience of illustration. Moreover, the insulation bobbins 5*a* and 5*b* may inclusively be referred to as an insulation bobbin 5 in some cases hereinafter. Likewise, other members may also be the same as are the cores 7*a* and 7*b* referred to as a core 7.

In the reactor 1, in the case of being for use in a DC/DC voltage converter (not illustrated) being one of power converters, an electric current is carried through the coil 6, and the reactor 1 performs a function as an induction body to charge and discharge an energy. The core 7 (7*a*, 7*b*) is made by molding soft magnetic materials such as iron dust core, electromagnetic steel plate, ferrite, sendust or permalloy. The cores 7*a* and 7*b* are preferably of the same shape and the same dimensions, and can employ an assembly of any ones selected at random from articles manufactured using a single machine or machining jig.

A wire conductor forming the coil 6 is coated with insulating enamel materials, and typically employs a flat-type wire of which cross section is substantially rectangular so as to increase a space factor for the purpose of downsizing the reactor.

The coil 6 is of the so-called edgewise winding in which coil is wound in a wide direction, and located so as to cover a columnar part 72 (72*a*, 72*b*) being a region on which the coil 6 is wound at the core 7 via the insulation bobbin 5 (5*a*, 5*b*). The leading end and trailing end of the wire conductor is machined so as to be terminals 61*a*, 61*b* for carrying an electric current at the reactor 1. By changing a voltage to be applied between one terminal 61*a* and the other terminal 61*b* of the coil 6, an electric current is carried through between the terminals.

In the reactor 1 for use in the DC/DC voltage converter, potential difference between the terminals 61*a* and 61*b* of the coil 6 is adjusted by changeover between an open-circuit state and a short-circuit state by switching a power semiconductor (not illustrated) to be connected to the terminals. By such adjustment of the potential difference, amount of increase or decrease in the electric current to be carried through the coil 6 is controlled, and thus the charge or discharge of energy to be conducted to the reactor 1 is adjusted resulting in voltage conversion. At this time, the increase or decrease of the electric current to be carried through the coil 6, changeover of polarity and the like occur, and the amount of magnetic flux passing through a magnetic path in the core 7 is changed.

Although the operating point of magnetic material of the core 7 moves on the B-H characteristic line representing a relationship between a magnetic flux density (B) and the intensity of a magnetic field (H) by the change of magnetic flux amount, due to hysteresis characteristics of magnetism, there occurs a loss corresponding to the are of a region represented by a movement locus of the operating point. This is a hysteresis loss of the core. Further, with respect to the change over time $d\Phi cr/dt$ of a magnetic flux ($\Phi cr$) passing in the interior of the core, there flows an eddy current acting to moderate this change of magnetic flux in the interior of the core, and due to electric resistance in this eddy current path, a loss being an eddy current loss takes place. The addition of these hysteresis loss and eddy current loss is known and described as iron loss, by which heat is generated at the core.

To reduce the eddy current loss of the core 7, in the case of using, for example, an electromagnetic steel plate as a magnetic material of the core, with the steel plate being a thin plate, an insulating coat is formed on the surface layer thereof to be laminated, whereby a loop diameter of the eddy current is made smaller and in this manner some contrivance to reduce an eddy current loss is made. Furthermore, in the case of using, for example, an iron dust core, as a magnetic material of the core, the particle diameter of an iron dust material is made to be as small as not more than 100 μm, an insulating coat is formed on the surface of each particle, and the insulation between particles is provided, thus being contrived to reduce an eddy current loss.

In addition, a loss takes place by the electric resistance with respect to the carried current through the coil 6. The loss has a DC component with respect to a carried DC current and an AC component with respect to a carried AC current due to change of the increase or decrease of electric current.

As factors of the AC component of a loss, there occurs a phenomenon referred to as skin effect in which due to change over time $d\Phi i/dt$ of a magnetic flux ($\Phi i$) to be induced in the wire conductor of the coil 6 so as to prevent the increase or decrease of electric current, an electric current is hard to be carried through the central portion of the wire conductor by the eddy current generated in the interior of the wire conductor. There occurs another phenomenon referred to as proximity effect in which due to the fact that wire conductors are adjacent to each other at the wire wound part of the coil 6, an electric current is likely to be carried biased on the surface portion of each wire conductor. There occurs, as described above, a further phenomenon in which a loss takes place due to eddy current generated at the wire conductor by interlinkage of a leakage flux at the magnetic gap portion of the core with the wire conductor of the coil 6.

Corresponding to that the higher the frequency of the increase or decrease in electric current, the higher the interlinkage frequency fs in leakage flux, thus the AC component of the loss of the coil is increased. The addition of the DC component and AC component of this coil loss is referred to as copper loss, whereby heat is generated at the coil 6.

As described above, the core 7 and the coil 6 are heated, and the generated heat is transferred to the mold resin 4, through the case 2, and radiated toward the heat sink 11. The case 2 serves to house the induction component 3 and to conduct the heat having been generated at the core 7 and the coil 6 and. In the case that high heat radiation is required, a metals is employed for the purpose of higher heat conduction properties. In addition, a part of the core 7 is in contact with the bottom face of the interior of the case 2, and heat is radiated toward the heat sink 11 also through this contacted portion.

Furthermore, the construction of the reactor 1 is now described in detail with reference to FIGS. 2 and 6.

Figure 6:
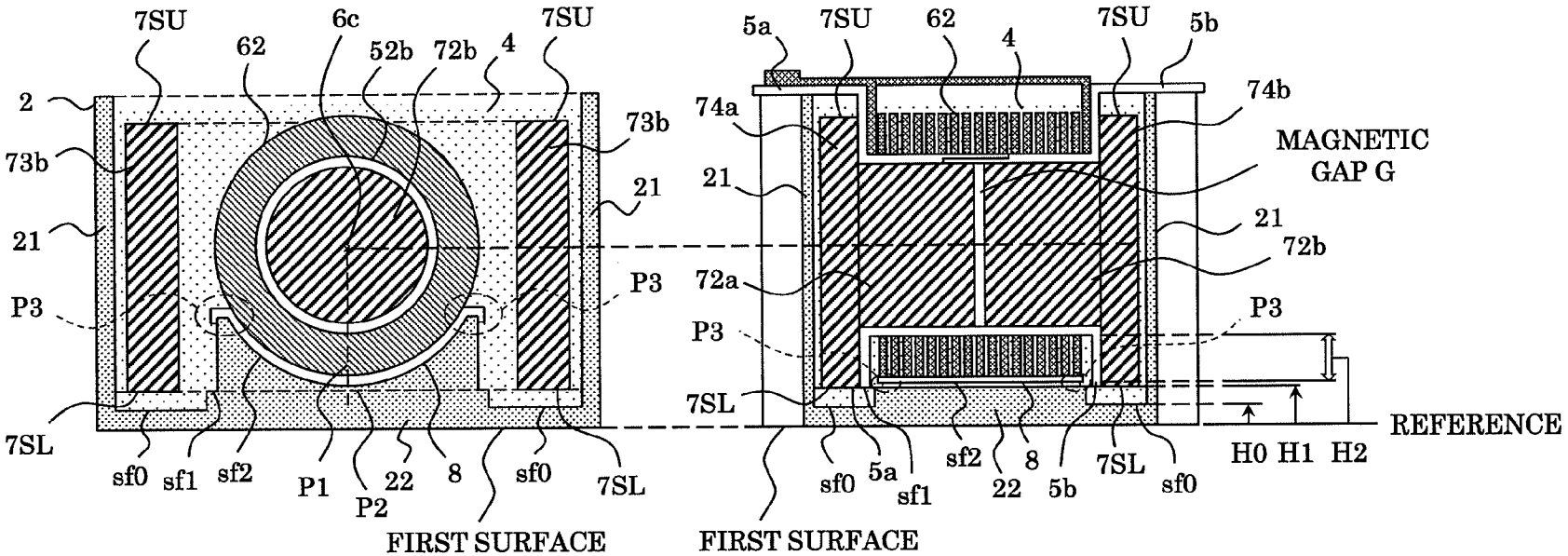
FIG. 6 is a sectional view illustrating an interior structure of the reactor of FIG. 1, and in which FIG. 6(*a*) is an elevation sectional view taken along the cross section A of FIG. 1 and FIG. 6(*b*) is a side sectional view taken along the cross section B of FIG. 1.

In FIG. 6, FIG. 6(*a*) is a sectional view taken along the cross section A of FIG. 1 and FIG. 6(*b*) is a sectional view taken along the cross section B of FIG. 1, and they illustrate the interior structure of the reactor according to the first embodiment. Cylindrical tubular parts 52*a* and 52*b* of a set of the insulation bobbins 5*a* and 5*b* are insert-fitted so as to be located about a central axis 6*c* of the coil 6, the insulation bobbins 5*a* and 5*b* are abutted, and the tubular part 52*a* and the leading part (engaging part 52*c*) of the tubular part 52*b* are engaged. In addition, the columnar parts 72*a*, 72*b* of the cores 7*a*, 7*b* are insert-fitted into the tubular parts 52*a*, 52*b* of the insulation bobbins 5*a*, 5*b*. In this process, they are mounted so that planar parts 53*a*, 53*b* of the insulation bobbins 5*a*, 5*b* are brought in contact with the inside surface of a side end parts 74*a*, 74*b* of the cores 7*a*, 7*b*.

A protrusion 54*b* is provided at the insulation bobbin 5*b* so as to determine the position of a lead wire extending to the terminal 61*b* of the coil 6 with respect to the circumferential direction of the tubular part 52*b*, and the lead wire is caught by the protrusion 54*b*.

Likewise, another protrusion (not illustrated) is provided at the insulation bobbin 5*a* so as to determine the position of a lead wire extending to the terminal 61*a* of the coil 6 with respect to the circumferential direction of the tubular part 52*a*, and the lead wire is caught by this protrusion.

Furthermore, the terminal 61*a*, 61*b* of the coil 6 is positioned and caught in the direction parallel to the flat top of the planar part 53*a* of the insulation bobbin 5*a* by another protrusion 56 that is provided on the top of the planar part 53*a* of the insulation bobbin 5*a*.

Due to that the terminals 61*a* and 61*b* of the coil 6 and the lead wires extending thereto are caught, the distance between the terminal 61*a* and terminal 61*b* of the coil 6 can be determined to be a predetermined value, and even if a high voltage is applied to the terminals 61*a* and 61*b*, an insulation distance (creepage distance) can be kept so as to obtain a desired insulation.

Moreover, the insulating enamel coating of the terminals 61*a*, 61*b* of the coil 6 is peeled off, and the terminals 61*a*, 61*b* are joined to a wire routing conductor (bus bar) not illustrated and electrically connected to the primary side of a DC/DC voltage convertor or a semiconductor element of a main circuit. At the insulation bobbin 5*a*, a terminal block 57 for joining of a bus bar is provided as an integral part thereof. The electrical connection between the terminals 61*a*, 61*b* and the bus bar is made by welding, thermal caulking or screw fastening using a crimp-style terminal.

Throughout the drawings of the invention, however, at the terminals 61*a*, 61*b* of the coil 6 and the terminal block 57 of the insulation bobbin 5*a*, the joining to the bus bar by screw fastening is illustratively shown.

In addition, an outer leg part 73*a* of the core 7*a* and an outer leg part 73*b* of the core 7*b* are abutted and fixed using fixing means such as adhesive or a securing member of which illustration is omitted.

There are some cases in which a magnetic gap G is formed at the portion where the columnar parts 72*a* and 72*b* of the cores 7*a* and 7*b* are opposed. On this occasion, in the region to be this magnetic gap G, a non-magnetic material such as adhesive, mold resin, ceramics or air is employed.

Now, housing of the induction component 3 in the case 2 is described with reference to FIGS. 3, 4, 5 and 6.

Figure 3:
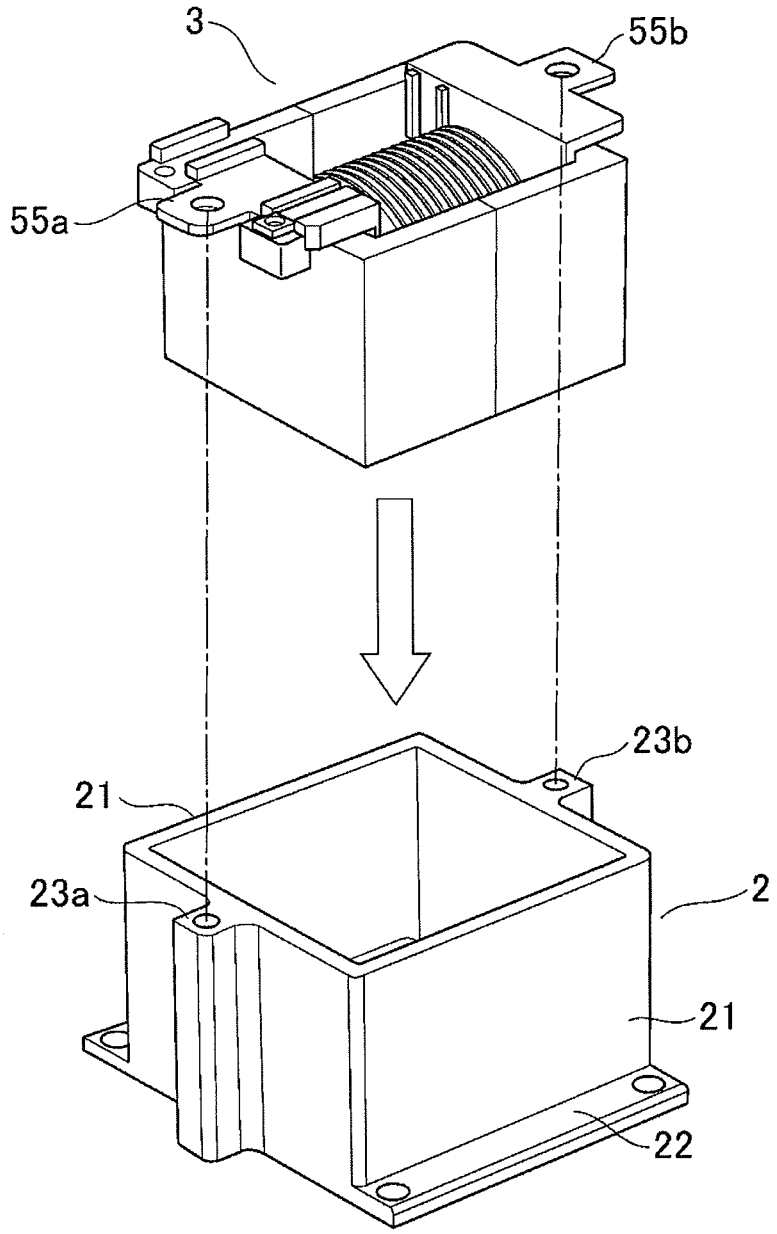
FIG. 3 is a view explaining an assembly of the reactor illustrated in FIG. 1.
Figure 4:
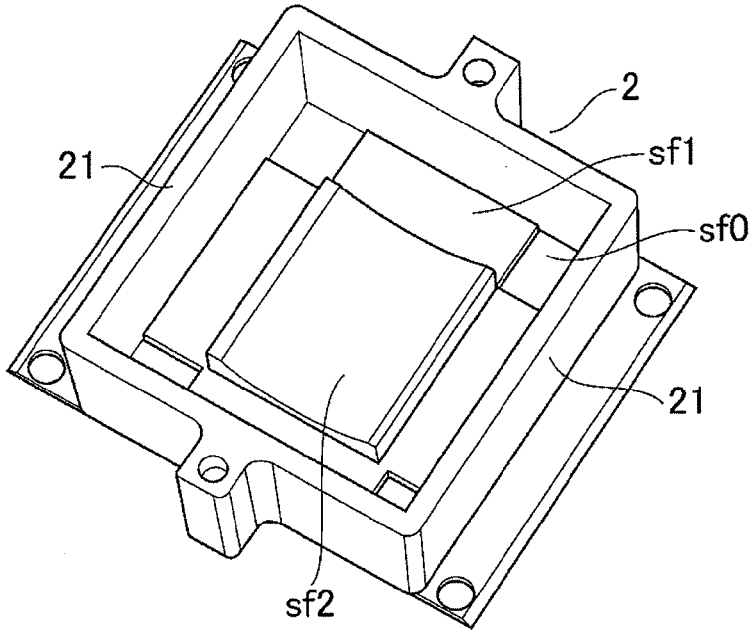
FIG. 4 is a perspective view illustrating a shape of a case of the reactor illustrated in FIG. 1.
Figure 5:
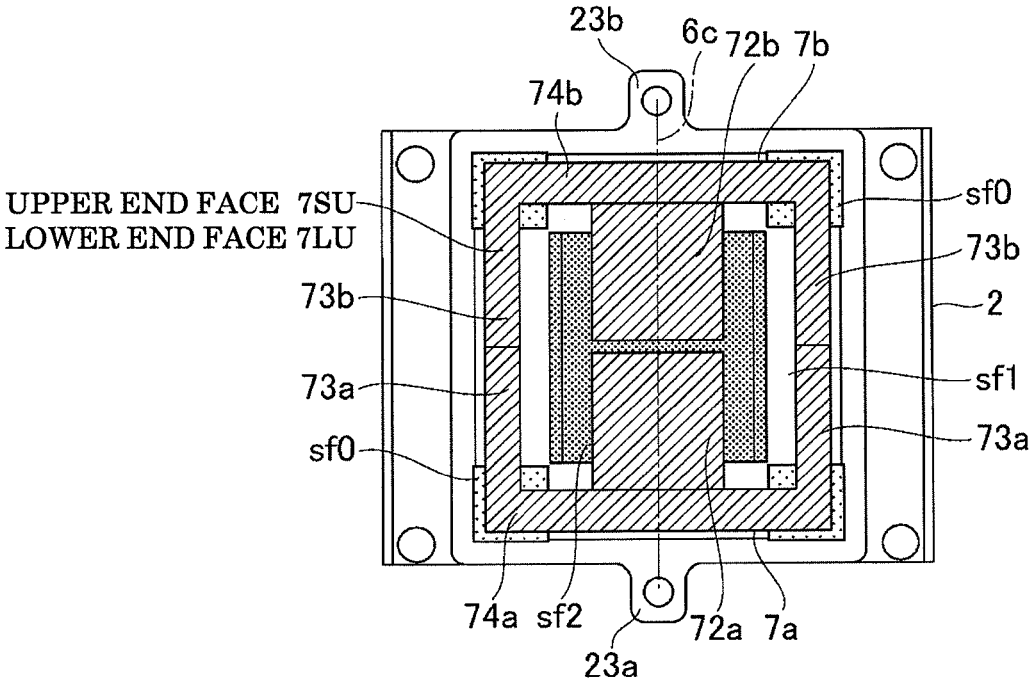
FIG. 5 is a projection view explaining a positional relationship between a case and a core of the reactor illustrated in FIG. 1.

FIG. 3 is a view illustrating an outline in the previous stage of housing the induction component 3 in the case 2. FIG. 4 is a perspective view illustrating details of the inner bottom of the case 2. FIG. 5 is a projection view explaining the positional relation between the interior of the case 2 and the core 7 viewed from above the open face of the case 2.

As is illustrated in FIG. 3, the case 2 is substantially a rectangular parallelepiped and houses the induction component 3 in the interior surrounded by side walls 21 with the top being an open face. A case bottom 22 has such a machined shape as to be attached to the heat sink 11 by, e.g., screw fastening.

The surface opposite to the open face of the case 2 that is the backside of the case bottom 22 is planar and contacted with the heat sink 11, and the heat generated by the induction component 3 is radiated to the heat sink 11 mainly via this backside face. The backside of the case bottom 22 is hereinafter referred to as a first surface.

Projections 23*a*, 23*b* are formed at the side wall 21 of the case 2. The projection 23*a* is screw-fastened to a protrusion 55*a* of the insulation bobbin 5*a* in the induction component 3. Likewise, the projection 23*b* is screw-fastened to a protrusion 55*b* of the insulation bobbin 5*b* in the induction component 3.

The inner bottom of the case 2 is as illustrated in FIG. 4. The inner bottom has three heights, that is, a region sf0, sf1 and sf2 in order of the low height letting the first surface a reference. The region sf0 is formed at four corners of the case inner bottom each of these four regions being of the same area. The region sf2 is formed into a shape of having an elevation difference of a cylindrical circumference at the central portion of the inner bottom within the range not to interfere with the region sf0 viewed from above the open face.

The region sf1 is a part excluding the regions sf0 and sf2 of the inner bottom of the case 2, and formed in a planar shape having a constant height letting the first surface a reference.

When the core 7 is projected onto the inner bottom in the interior of the case 2 viewed from above the open face of the case 2, it is illustrated as in FIG. 5.

As in FIG. 5, the peripheral shape of the core is square-shaped (□-shaped) with the outer leg part 73*a* and side end part 74*a* of the core 7*a*, and the outer leg part 73*b* and side end part 74*b* of the core 7*b*. Inside the square shape (□-shape), there are resided the columnar part 72*a* of the core 7*a* and the columnar part 72*b* of the core 7*b*, and the central axis 6*c* of the coil 6, and the axis of the columnar parts 72*a*, 72*b* of the core 7 is positioned so as to be substantially aligned on the line providing a connection between centers of each screw hole to be formed at the top end of the projections 23*a*, 23*b* of the side wall 21 of the case 2.

In FIG. 5, the core 7 of which peripheral shape is square-shaped is positioned at the central portion in the crosswise direction and in the vertical direction of the drawing with respect to the side wall 21 of the case 2, and a distance from the square-shaped core to the side wall 21, that is, a gap to be filled with the mold resin 4 on the outside of the square shape is substantially equidistant in both crosswise direction and vertical direction of the drawing. Therefore, when heat is transferred from the square-shaped core to the side wall 21 via the mold resin 4, lack of balance or variation is reduced.

The region sf0 being the lowest surface of the inner bottom of the case 2 is at four corners, and each region has an area overlapped inward and outward of the square shape at the corner portion of the square-shaped core 7.

Furthermore, the region sf2 in which the elevation difference of the cylindrical circumference is formed is positioned so that the central axis of this cylinder is aligned on the projected line of the central axis 6*c* of the above-mentioned coil 6 on the inner bottom.

The turn circumference of the wire wound part 62 of the coil 6 and the above-mentioned cylindrical circumference are matched in the state that a thickness of an insulating member 8 to be interposed between the lower portion of the turn circumference of the wire wound part 62 and the region sf2 on the inner bottom of the case 2 is included.

That is, the lowermost part of the turn circumference of the wire wound part 62 of the coil 6 is positioned and arranged via the insulating member 8 at the lowest position of elevation difference of the cylindrical circumference to be formed in the region sf2 of the inner bottom of the case 2.

In addition, as described above, the cylindrical tubular parts 52*a* and 52*b* of the insulation bobbins 5*a* and 5*b* are positioned so as to be insert-fitted about the central axis 6*c* of the coil 6, the insulation bobbins 5*a* and 5*b* are abutted, and the tubular parts 52*b* and the leading part (engaging part 52*c*) of the tubular part 52*b* are engaged. Further, the columnar parts 72*a* and 72*b* of the cores 7*a* and 7*b* are insert-fitted into the tubular parts 52*a* and 52*b* of the insulation bobbins 5*a* and 5*b*.

Thus, at the time of housing the induction component 3 in the case 2, the protrusion 55*a* of the insulation bobbin 5*a* in the induction component 3 and the projection 23*a* of the side wall 21 of the case 2 are fastened with a screw, and further the protrusion 55*b* of the insulation bobbin 5*b* and the projection 23*b* of the side wall 21 of the case 2 are fastened with another screw, thus positioning between the core 7 and the case 2 is made.

As described above, the coil 6, the core 7 and the insulation bobbin 5 are positioned in the interior of the case 2 to be in such a layout as is illustrated in FIG. 5. The above-mentioned positioning is effective in the case of a reactor that is machined to be small-sized and of small dimensions such as an on-vehicle reactor as well as in the case of need for considerations of insulation at high voltages.

Although typical causes of the fault of a reactor include loss of desirable insulation properties, in order to secure sufficient insulation properties as well as to reduce the failure or fault of the product, it is desired to leave a space (to have an insulation distance) between parts necessary to be insulated so as to match a desired insulation voltage. Too large distance, however, is contrary to the need for a smaller-sized reactor. Therefore, although a reactor is preferably constructed in dimensions having a minimally necessary insulation distance, in the event of variation in layout of parts in the machining process of assembling a reactor, there is the possibility of manufacturing defective products having no desired insulation properties.

According to the positioning mechanism of the invention, however, a reactor having a sufficient insulation distance with no variation as well as having desired insulation properties, in spite of small sizes and small dimensions, can be manufactured with easy machinability in a short time.

Subsequently, interior structure of the reactor after the mold resin 4 has been charged is now described in detail with reference to FIG. 6.

As described above, FIG. 6(*a*) is a sectional view taken along the cross section A of FIG. 1, and FIG. 6(*b*) is a sectional view taken along the cross section B of FIG. 1. Hereinafter, FIG. 6(*a*) is referred to as elevation sectional view, and FIG. 6(*b*) is referred to as side sectional view.

Now, descriptions are made with reference to the elevation sectional view of FIG. 6(*b*). With reference to FIG. 6(*b*), the portion illustrating the region sf0 on the inner bottom of the case 2, the portion illustrating the terminals 61*a*, 61*b* of the coil 6 and the lead wires connected thereto are shown in another cross section parallel to the cross section B in order to make it easy to describe the interior structure of the reactor.

In the side sectional view of FIG. 6(*b*), the side end part 74*a* of the core 7*a*, on the left side of the drawing, and the side end part 74*b* of the core 7*b*, on the right side of the drawing, is positioned leaving a space substantially equidistantly from respective side walls 21 of the case 2. The columnar part 72*a* extending from the side end part 74*a* of the core 7*a* and the columnar part 72*b* extending from the side end part 74*b* of the core 7*b* are in opposition in the crosswise direction of the drawing, and their opposed end faces are spaced with a non-magnetic material to have a magnetic gap G.

The columnar part 72*a* of the core 7*a* is insert-fitted into the tubular part 52*a* of the insulation bobbin 5*a*, and inside surface of the side end part 74*a* of the core 7*a* is in contact with the planar part 53*a* of the insulation bobbin 5*a*. Furthermore, the columnar part 72*b* of the core 7*b* is insert-fitted into the tubular part 52*b* of the insulation bobbin 5*b*, and inside surface of the side end part 74*b* of the core 7*b* is in contact with the planar part 53*b* of the insulation bobbin 5*b*.

The wire wound part 62 of the coil 6 is insert-fitted to the tubular part 52*a* of the insulation bobbin 5*a* and the tubular part 52*b* of the insulation bobbin 5*b* about the central axis 6*c*. In addition, the terminals 61*a* and 61*b* of the coil 6 and the lead wires connected thereto are caught by the protrusion 56 on the insulation bobbin 5*a* and spaced from the side end part 74*a* of the core 7*a*.

Owing to such arrangement as described above, the insulation between the coil 6 and the columnar parts 72*a*, 72*b* of the core 7 and between the coil 6 and the side end part 74*a*, 74*b* of the core 7 is made through the insulation bobbin 5.

The lower end face 7SL of the side end part 74*a* of the core 7*a* and the side end part 74*b* of the core 7*b* is in contact with the region sf1 of the inner bottom of the case 2 at an equal height. A part of generated heat in the core 7 is transferred through the lower end face 7SL from the region sf1 to the case bottom 22 and radiated to the heat sink 11.

Further, the lower portion of the wire wound part 62 of the coil 6 is in contact with the region sf2 of the inner bottom of the case 2 through the insulating member 8. Although the coil 6 and the case 2 are most approached at this point, they are insulated from each other through the insulating member 8.

Letting the first surface being the lowermost part of the case 2 a reference, the region sf0 on the inner bottom of the case 2 is lower than the other regions sf1 and sf2. When letting the height of the region sf0 H0, the height of the region sf1 H1 and the height of the region sf2 H2, there is a relationship of H0<H1<H2. Since the lower end face 7SL of the core 7 is in contact with the region sf1 of the inner bottom of the case 2 as well as there is the height relationship of H0<H1, with respect to the side wall 21 of the case 2, under the side end part 74*a* of the core 7*a* being a part of the core 7 of which top view has a square-shaped peripheral shape, a space communicating with the inside and outside of the above-mentioned square shape is formed, and under the side end part 74*b* of the core 7*b* being a part of the core 7, a space communicating with the inside and outside of the above-mentioned square shape is formed.

The mold resin 4 gets over an upper end face 7SU of the core 7 in the interior of the case 2 and is charged up to the height of covering the upper portion of the wire wound part 62 of the coil 6, and thus the coil 6, the core 7, the insulation bobbin 5 and the insulating member 8 are immersed with the mold resin 4. The mold resin 4 is injected or poured in liquid state, then heated and set. Employed as the mold resin 4 is a mixture of a base material, for example, epoxy resin, silicone resin and urethane resin and an insulating filler material (alumina, aluminum hydroxide and the like) acting to improve heat conduction properties.

Now, descriptions are made with reference to the elevation sectional view of FIG. 6(*a*). Referring to FIG. 6(*a*), the outer leg part 73*b* of the core 7*b* is positioned leaving a space equidistantly from the side wall 21 on both the left side and the right side in the vicinity of the side wall 21 of the case 2. This is the same also in another cross section parallel to the cross section A of FIG. 1. Furthermore, the outer leg part 73*a* of the core 7*a* is positioned leaving a space equidistantly from the side wall 21 on both the left side and the right side in the vicinity of the side wall 21 of the case 2 as well.

At the central portion of FIG. 6(*a*), the columnar part 72*b* of the core 7*b* is located so that its axis is coincident with the central axis 6*c* of the coil 6, and there are coaxially with this columnar part 72*b* the tubular part 52*b* of the insulation bobbin 5*b* and the wire wound part 62 of the coil 6. The lower portion of the turn circumference of the wire wound part 62 of the coil 6 is in contact with the region sf2 on the inner bottom of the case 2 via the insulating member 8.

The lowermost point P1 of the turn circumference of the wire wound part 62 of the coil 6 is an intersection point of the perpendicular line to the first surface of the case 2 from the central axis 6*c* of the coil 6 and the turn circumference of the wire wound part 62. In addition, the intersection point of this perpendicular line and the region sf2 being an extension of this perpendicular line, is the lowermost point P2 in elevation difference of the cylindrical circumference.

That is, at the time of housing the induction component 3 in the case 2, its positioning is made so that the lowermost point P1 of the turn circumference of the wire wound part 62 of the coil 6 is aligned on the straight line providing a connection between the central axis 6*c* of the coil 6 and the lowermost point P2 in elevation difference of the cylindrical circumference of the region sf2 on the inner bottom of the case 2.

By such positioning, although the wire wound part 62 of the coil 6 and the case 2 come near, there is interposed the insulating member 8 therebetween as well as the positioning between the case 2 and the wire wound part 62 of the coil 6 is made. Accordingly, it comes to be possible to secure an insulation distance between the case 2 and the coil 6 with no variation.

Incidentally, when applying a high voltage to the terminal 61*a*, 61*b* of the coil 6, although there are concerns that an electric current is carried round the surface layer (creepage surface) of the insulating member 8 at the end portion of the insulating member 8 and there occurs a dielectric breakdown between the wire wound part 62 and the case 2, to cope with this, the insulating member 8 is formed so as to have a creepage distance not to give rise to the dielectric breakdown (Point P3 in FIGS. 6(*a*) and 6(*b*)).

The lower end face 7SL of the outer leg part 73*a* of the core 7*a* and the outer leg part 73*b* of the core 7*b* are in contact with the region sf1 on the inner bottom of the case 2 at an equal height as well as the relationship of their heights is H0<H1. Thus, with respect to the core 7*a* being a part of the core 7 of which top view has a square-shaped peripheral shape to the side wall 21 of the case 2, a space communicating with the inside and outside of the above-mentioned square shape is formed under the outer leg part 73*a* and concerning the core 7*b*, and a space communicating with the inside and outside of the above-mentioned square is formed under the outer leg part 73*b*.

The mold resin 4 is charged in the interior of the case 2, and the coil 6, the core 7, the insulation bobbin 5 and the insulating member 8 are immersed.

In addition, insulation properties between the wire wound part 62 of the coil 6, and the outer leg part 73*a* of the core 7*a* and the outer leg part 73*b* of the core 7*b* is obtained and secured not by the insulating material of a solid structure of the insulation bobbin 5 and the insulating member 8 but by such a layout leaving a space so as not to occur a dielectric breakdown in the air. Although the insulation between the wire wound part 62 and the outer leg parts 73*a*, 73*b* may depend on insulation properties the mold resin 4 possesses as a material, it is supposed that the mold resin 4 is insufficiently charged, air bubbles come in, cracks are generated and thus moisture gets therein, eventually leading to such a fault as the deterioration of insulation properties, and therefore an insulation distance is set.

Owing to this setting of an insulation distance, the volume of a mold resin 4*i* to be charged in the inside surrounded by the square-shaped structure formed by the outer leg part 73*a* and the side end part 74*a* of the core 7*a*, and the outer leg part 73*b* and the side end part 74*b* of the core 7*b* is larger than the volume of a mold resin 4*o* to be charged to the side wall 21 of the case 2 outside the square-shaped structure.

<Machinability of Resin Mold>

As described above, a reactor for use in a power converter for an electric power train for automobiles is small-sized and lightweight, and as compared to a reactor for other applications, the reactor is required to achieve higher power density and higher current density. Since this reactor deals with a large electric power in spite of its small size, it is necessary to efficiently radiate the heat generated by an induction component and to suppress the deterioration of insulation properties of the enamel coating due to temperature rise of the coil, thereby giving rise to no fault in a desired service life.

Therefore, a filler material having high thermal conductivity for the purpose of improving heat radiation is mixed in the mold resin to be injected in the case.

When mixing a filler material therein, however, viscosity of the mold resin 4 is increased and thus the mold resin 4 is hard to spread into the reactor. This viscosity is, for example, a value well exceeding 15 Pa·sec at the room temperature of 25 degrees centigrade, and thus it takes a long time for the mold resin to spread into a narrow gap such as between turns of the wire wound part of the coil or spreading itself comes to be difficult.

To deal with such problems, the induction component 3 being a body to be injected and the case 2 are heated, as well as the mold resin 4 itself is heated up to about 50 degrees centigrade, and thus its viscosity is tried to be reduced.

However, even if the mold resin 4 is heated and reduced in viscosity, its viscosity still remains about 4 Pa·sec, and it is difficult for the mold resin 4 to spread into such a narrow gap as is 2 mm to 3 mm in a short time. Moreover, since the rate of the change of viscosity with respect to the temperature change comes to be higher, in the case that the heated state of the mold resin 4 or the heated state of the reactor 1 varies at injection facilities, there may be variation in viscosity. Thus, the injection state of the mold resin into the reactor becomes unstable and a longer time is needed for injection step, resulting in worse machinability and higher manufacturing cost.

To solve such problems, when the mold resin 4 is injected or poured into one reactor from two or more points by providing a plurality of injection facilities, in spite of shorter injection time, there is an increased possibility that air bubbles get mixed in due to turbulent flow of the mold resin. A burden of acquiring a larger installation area for the facilities or a burden of higher machine cost owing to the provision of the plurality of injection facilities eventually results in increase of manufacturing cost.

According to the invention, the above-mentioned problems are solved, even in the case of mold resin injection in which a filler material acting to improve a thermal conductivity is mixed from single injection equipment, it is possible to sufficiently spread a resin between turns of the wire wound part of the coil as well as to cause the mold resin to come round in the entire reactor in a short time. This coming round performance of mold resin is now described with reference to FIG. 7.

Figure 7:
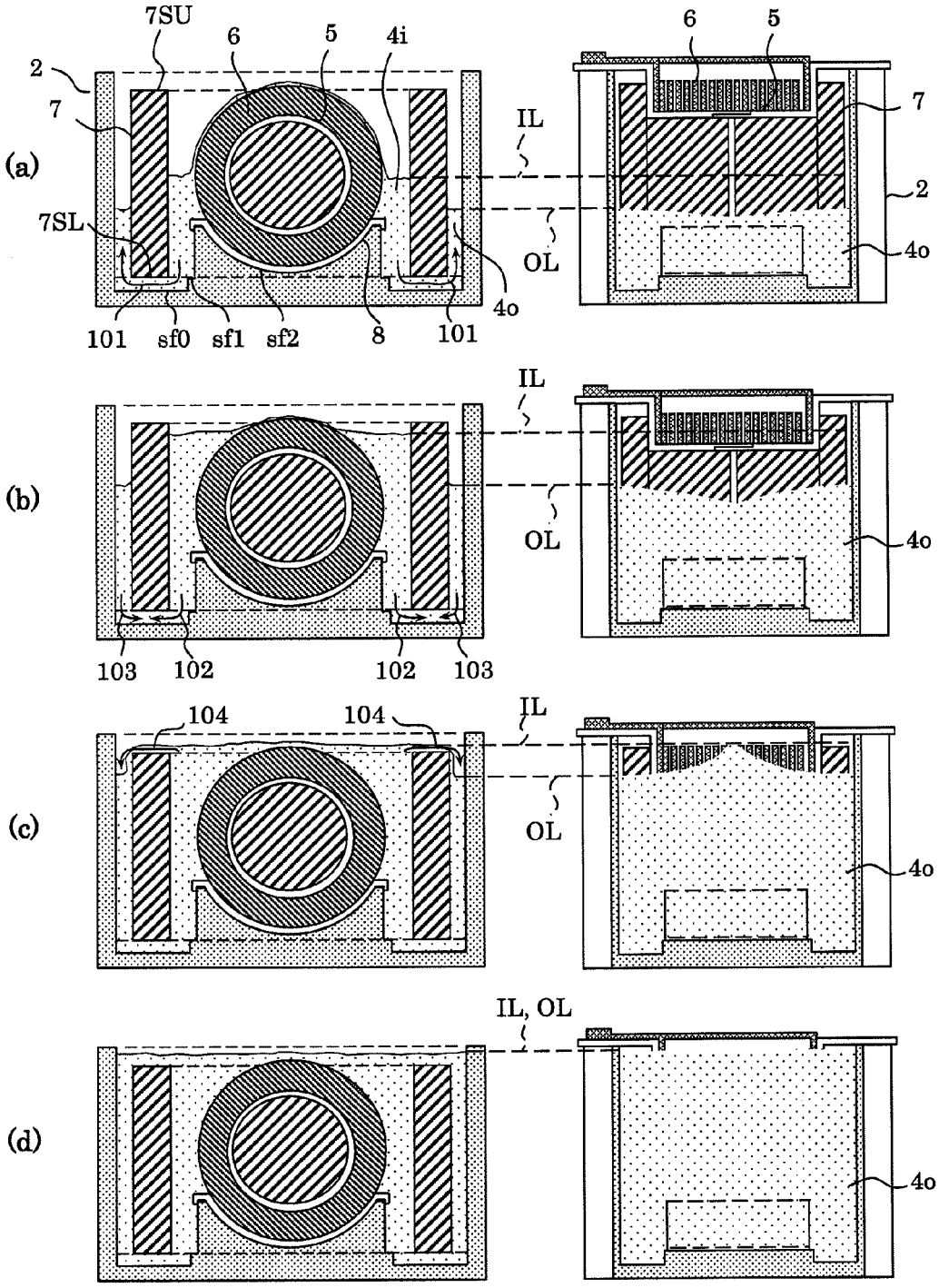
FIG. 7 is a view explaining a injection process of a mold resin of the reactor illustrated in FIG. 1.

FIG. 7 is a view explaining a time-series injection process of the mold resin 4 into the reactor 1, and corresponds to the elevation sectional view of FIG. 6(*a*) and the side sectional view of FIG. 6(*b*). Especially, the side sectional views illustrated on the right side show repeatedly the state of the mold resin 4*o* to be charged in the outside of the square-shaped structure of the core 7. Therefore, although the cross section of the wire wound part 62 of the coil 6 is shown in the drawings, the injected state of mold resin is the one of the mold resin 4*o*.

The mold resin 4 is injected from above the central portion of the top of the wire wound part 62 of the coil 6, and while being spread into between turns of the wire wound part 62, comes to be charged in the inside surrounded by the square-shaped structure of the core 7 as the mold resin 4*i*.

Referring to FIG. 7(*a*), while the liquid level IL of the mold resin 4*i* is reaching near the height of the center of the columnar part 72*a* of the core 7, the mold resin 4 flows substantially uniformly to four corners on the inner bottom of the case 2 as the mold resin 4*o* on the outside of the square-shaped structure of the core 7 through the space to be formed between the region sf0 at the four corners of the inner bottom of the case 2 and the lower end face 7SL of the core 7. This flow of the mold resin 4 is illustrated as indicated by the arrow 101.

The liquid level OL of the mold resin 4*o* is rather low than the liquid level IL of the mold resin 4*i*, as well as the liquid level of the mold resin 4*o* just over the four corners on the inner bottom of the case 2 is higher than the liquid level just over the midpoint between the four corners on the inner bottom. This occurs due to that the gap between the core 7 and the side wall 21 of the case 2 is narrow and it is delayed for the mold resin 4*o* to come round just over the midpoint.

When the injection of the mold resin 4 continues further, as shown in FIG. 7(*b*), the liquid level IL of the mold resin 4*i* gets near to the upper end face 7SU of the core 7 on the inside of the square-shaped structure of the core 7. Whereas, although the liquid level OL of the mold resin 4*o* rises on the outside of the square-shaped structure of the core 7, its rise pace is slower than the rise pace of the liquid level IL of the mold resin 4*i*. This, together with the self weight of the mold resin 4*o* and the viscosity of the mold resin 4, is due to that an impetus (indicated by the arrow 102) flowing from inside to outside of the square-shaped structure of the core 7 and an impetus (indicated by the arrow 103) pressing back from outside to inside stand against each other.

The continuous injection of the mold resin 4 is brought in the state illustrated in FIG. 7(*c*).

The liquid level IL of the mold resin 4*i* on the inside of the square-shaped structure of the core 7 gets over the upper end face 7SU of the core 7 to rise to the level of covering the uppermost portion of the wire wound part 62 of the coil 6, and thus reaches the liquid level substantially equal to that at the time of completion of the injection.

Meanwhile, to the outside of the square-shaped structure of the core 7, the mold resin 4*i* inside gets over the upper end face 7SU of the outer leg part 73*a* of the core 7*a* and the outer leg part 73*b* of the core 7*b* to flow out, and thus raises the liquid level OL of the mold resin 4*o*. This flow of the mold resin 4 is illustrated as indicated by the arrow 104.

Note that in the elevation sectional view of FIG. 7(*c*), as to the flow of the mold resin 4 from inside to outside of the square-shaped structure of the core 7, the flow getting over the upper end face 7SU of the left-side outer leg part 73*b* and the flow getting over the upper end face 7SU of the right-side outer leg part 73*b* are substantially similar. Therefore, there is no occurrence of turbulent flow of the mold resin 4 and thus no air bubbles are mixed in, as well as there is no variation in resin injection in each individual product manufactured.

Furthermore, in the final stage of injection of the mold resin 4, the injection state becomes as illustrated in FIG. 7(*d*).

The liquid level IL of the mold resin 4*i* on the inside of the square-shaped structure of the core 7 is equal to the liquid level OL of the mold resin 4*o* on the outside, and the mold resin 4*i* covers the upper end face 7SU of the core 7 or the uppermost portion of the wire wound part 62 of the coil 6 resulting in completion of the injection.

As described above, according to the first embodiment of the invention, meeting the needs for an on-vehicle reactor, despite a reactor of small sizes and of high power density, the heat generated by the induction body generates is efficiently radiated. Thus, the reactor according to the first embodiment can prevent such disadvantages as the occurrence of dielectric breakdown due to decomposition of enamel coating due to temperature rise of the coil, or the unintended contact state at the boundary between mold resin and any member such as core, case or coil caused by expansion or contraction due to repeated high temperatures or low temperatures at the time of operation or non-operation of the reactor thus not to obtain a predetermined heat radiation.

In addition, even in the case of machining a reactor of small sizes and of small dimensions, since the positioning of the coil 6, the core 7 and the insulation bobbin 5 in the interior of the case 2 is reliably achieved, there is no variation in insulation distance at the points needed to be insulated, thus enabling to prevent the manufacturing of a defective product having no insulation properties.

Moreover, by such positioning, the space to be charged with a mold resin between the induction component and the case does not vary for each individual product manufactured, and there is no variation in the aspects of incoming round performance of the mold resin, heat conduction in the heat radiation path via the mold resin, application way of a stress caused by expansion or contraction due to repeated high temperatures or low temperatures and the resistance of the mold resin to this stress, thus enabling to manufacture a reactor having a stable heat radiation and sufficiently ensuring a desired service life.

Further, a resin comes round well even in the case of using a mold resin in which a filler material is mixed to be increased in viscosity, the mold resin is injected from just one point, and there is no necessary of providing a plurality of equipments for injection or moving the injection nozzle position resulting in extensive facilities, thereby enabling to shorten the time required for injection and to reduce manufacturing cost.

Embodiment 2.

Figure 8:
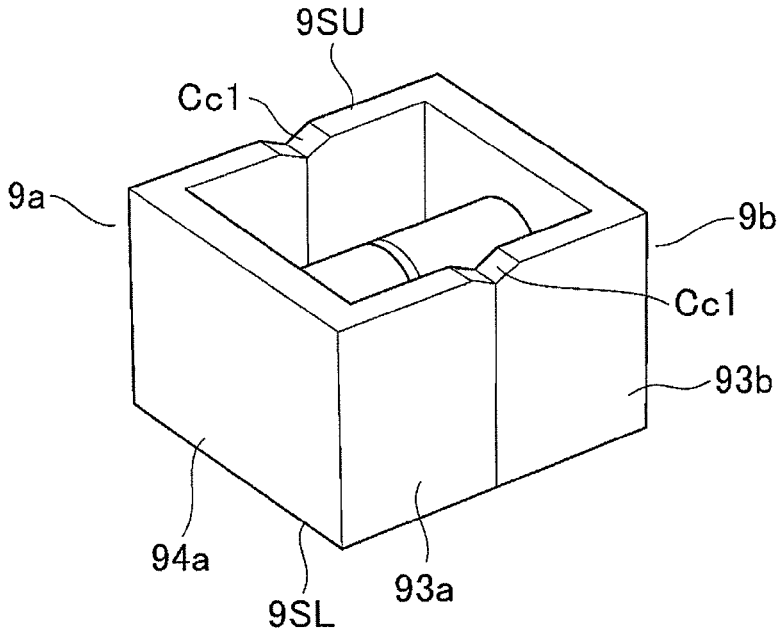
FIG. 8 is a view illustrating the assembled state of a core of a reactor according to a second embodiment of the invention.
Figure 9:
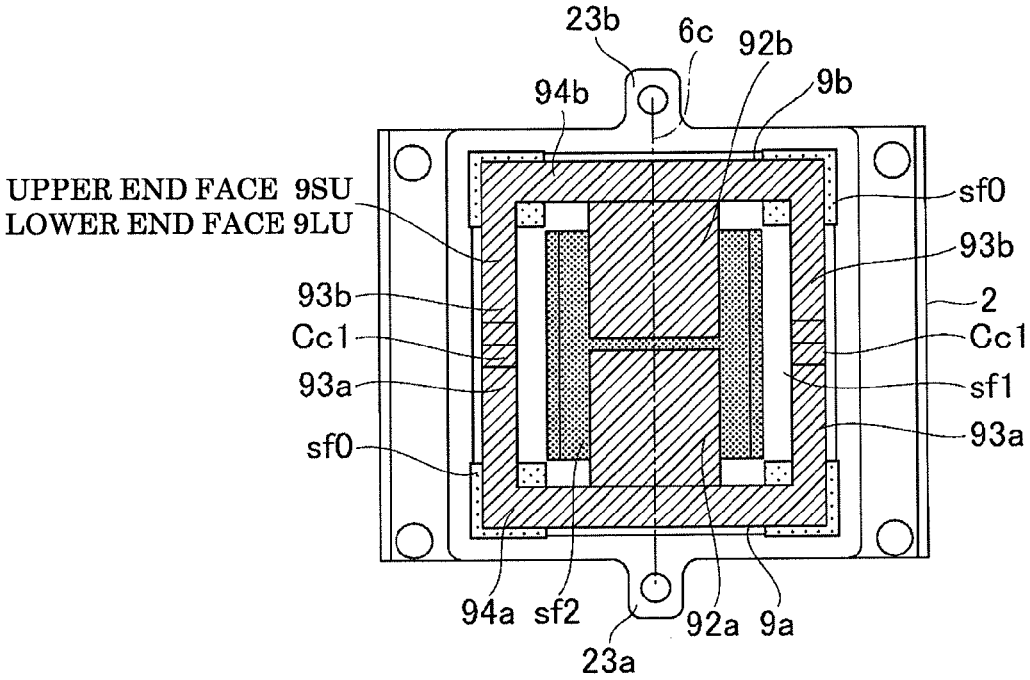
FIG. 9 is a projection view explaining a positional relationship between a case and a core of the reactor according to the second embodiment of the invention.

FIG. 8 is a perspective view illustrating an assembled state of a core 9*a* and a core 9*b* of the induction component 3 of the reactor 1 according to a second embodiment. FIG. 9, in the same manner as in FIG. 5, shows a projection view explaining the positional relationship between the interior of the case 2 and the core 9*a*, 9*b* taken from above the open face of the case 2.

In the second embodiment, the induction component 3 includes the core 9*a*, 9*b* instead of the core 7*a*, 7*b* in the first embodiment. The columnar part 72*a*, the outer leg part 73*a* and the side end part 74*a* of the core 7*a* in the first embodiment correspond to a columnar part 92*a*, an outer leg part 93*a* and a side end part 94*a* of the core 9*a*. Further, the columnar part 72*b*, the outer leg part 73*b* and the side end part 74*b* of the core 7*b* correspond to a columnar part 92*b*, an outer leg part 93*b* and a side end part 94*b* of the core 9*b*.

Moreover, the upper end face 7SU and lower end face 7SL of the outer leg part 73*a* and side end part 74*a* of the core 7*a*, and the outer leg part 73*b* and side end part 74*b* of the core 7*b* correspond to an upper end face 9SU and lower end face 9SL of the outer leg part 93*a* and side end part 94*a* of the core 9*a*, and the outer leg part 93*b* and side end part 94*b* of the core 9*b*.

In the description hereinafter, the cores 9*a* and 9*b* may inclusively be referred to as a core 9 in some cases.

In the second embodiment, when the core 9 is used instead of the core 7 to form the reactor 1 and the induction component 3 being a part thereof. In the detailed construction of the reactor 1 according to the first embodiment, when each part 72*a*, 73*a*, 74*a* of the above-mentioned core 7*a* is read as each part 92*a*, 93*a*, 93*a* of the core 9*a*, each part 72*b*, 73*b*, 74*b* of the core 7*b* is read as each part 92*b*, 93*b*, 94*b* of the core 9*b* as well as the upper end face 7SU is read as an the upper end face 9SU and the lower end face 7SL is read as the lower end face 9SL, then a detailed construction of the reactor 1 according to the second embodiment is formed.

Therefore, description of portions having like advantages by the same construction or function is omitted herein.

With reference to FIG. 8, the outer leg part 93*a* of the core 9*a* are abutted with the outer leg part 93*b* of the core 9*b*, and the cores 9*a* and 9*b* are fixed by fixing means such as adhesive or any other securing member. A part of the top on the abutted face of the outer leg part 93*a* and the outer leg part 93*b* is notched, and a notch Cc1 lower in height than the upper end face 9SU is formed.

Owing to the use of the core 9*a* and the core 9*b* of the same shape and of the same dimensions, the notch Cc1 is positioned substantially at the midpoint between the side end part 94*a* of the core 9*a* and the side end part 94*b* of the core 9*b*.

A projection view of the inner bottom of the core 9 in the interior of the case 2 taken from above the open face of the case 2 is illustrated in FIG. 9.

Referring to FIG. 9, the peripheral shape of the core comes to be square-shaped with the outer leg part 93*a* and side end part 94*a* of the core 9*a*, and with the outer leg part 93*b* and side end part 94*b* of the core 9*b*. The columnar part 92*a* of the core 9*a* and the columnar part 92*b* of the core 9*b* are resided inside the square shape and positioned so that the central axis 6*c* of the coil 6 and the axis of the columnar parts 92*a* and 92*b* of the core 9 are aligned substantially on the line providing a connection between both screw holes formed on the top of the projections 23*a* and 23*b* of the side wall 21 of the case 2.

In FIG. 9, the core 9 of which peripheral shape is square-shaped is positioned at the central portion in the crosswise direction and in the vertical direction on the drawing with respect to the side wall 21 of the case 2, and a distance from the square-shaped core to the side wall 21, that is, a gap to be filled with the mold resin 4 on the outside of the square shape are substantially equidistant in both crosswise direction and vertical direction on the drawing. Therefore, when heat is transferred from the square-shaped core to the side wall 21 via the mold resin 4, non-uniform performance or variation is reduced.

Although the upper end of the outer leg part 93*a*, 93*b* and the side end part 94*a*, 94*b* of the square-shaped core is substantially occupied by the upper end face 9SU, the above-mentioned notch Cc1 is lower in height than the upper end face 9SU. Owing to that the core 9 is positioned at the central portion in the crosswise direction and in the vertical direction on the drawing inside the case 2, the notch Cc1 is located midway in the vertical direction with respect to the regions sf0 at four corners on the inner bottom of the case 2.

Now, coming round performance of the mold resin 4 in the reactor 1 is described with reference to FIGS. 7 and 10.

The core 7 illustrated in FIG. 7 is to be read as the core 9, the upper end face 7SU is to be read as the upper end face 9SU and the lower end face 7SL is to be read as the lower end face 9SL respectively. The mold resin 4 is injected or poured from above the upper central portion of the wire wound part 62 of the coil 6 and, while being spread into between turns of the wire wound part 62, comes to be charged in the inside surrounded by the square-shaped structure of the core 9 as the mold resin 4*i*.

In FIG. 7(*a*), while the liquid level IL of the mold resin 4*i* is nearly reaching the height of the center of the columnar part 92*a* of the core 9, the mold resin 4 flows substantially uniformly to four corners on the inner bottom of the case 2 as the mold resin 4*o* outside the square-shaped structure of the core 9 through the space to be formed between the region sf0 at the four corners on the inner bottom of the case 2 and the lower end face 9SL of the core 9. This flow of the mold resin 4 is illustrated as indicated by the arrow 101.

Figure 10:
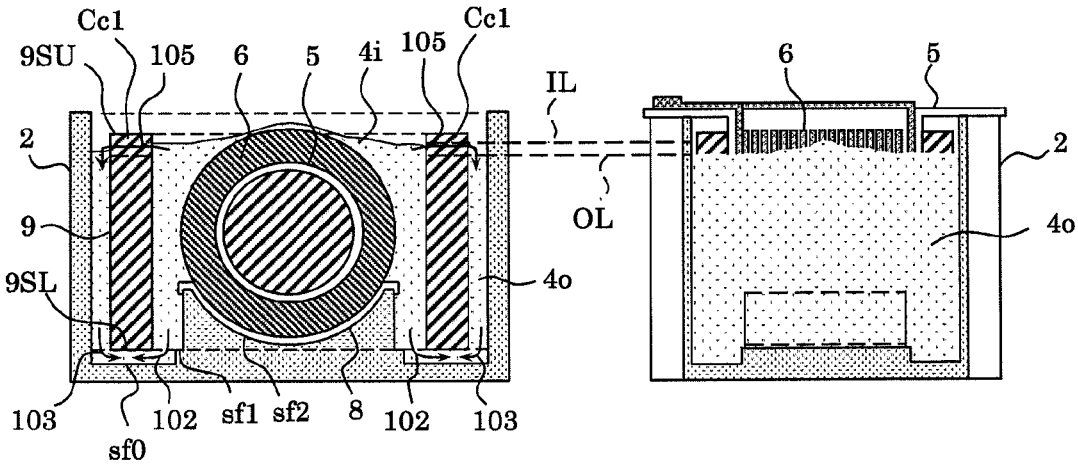
FIG. 10 is a view explaining a part of the injection process of the mold resin of the reactor according to the second embodiment of the invention.

When the injection of the mold resin 4 continues further, it comes to the state illustrated in FIG. 10. In the same manner as in FIG. 7, FIG. 10 corresponds to the elevation sectional view of FIG. 6(*a*) and the side sectional view of FIG. 6(*b*). Especially, the side sectional view illustrated on the right side shows repeatedly the state of the mold resin 4*o* to be charged on the outside of the square-shaped structure of the core 9. In addition, in the elevation sectional view shown on the left side, the notch Cc1 is illustrated and the mold resin 4 flowing therethrough is indicated by the arrows.

In FIG. 10, the liquid level IL of the mold resin 4*i* gets near to the upper end face 9SU of the core 9 inside the square-shaped structure of the core 9. At the same time, apart of the mold resin 4*i* flows in the direction of the arrow 105 from inside to outside of the square-shaped structure through the notch Cc1 of the core 9 to be the mold resin 4*o*.

Note that in the elevation sectional view shown in the left-side view of FIG. 10, as to the flows of the mold resin 4 from the inside to the outside of the square-shaped structure of the core 9, the flow through the left-side notch Cc1 and the flow through the right-side notch Cc1 are substantially the same, and therefore there occurs no such an event as air bubbles are mixed in by turbulent flow of the mold resin 4, as well as there is no variation in resin injection in each individual product manufactured.

Meanwhile, together with the self weight of the mold resin 4*o* and the viscosity of the mold resin 4, an impetus (indicated by the arrow 102) flowing from inside to outside of the square-shaped structure of the core 9 and an impetus (indicated by the arrow 103) pressing back from outside to inside stand against each other, amount of the mold resin 4 to flow through the space in the vicinity of the region sf0 on the inner bottom of the case 2 is decreased.

Further, in the final stage of injection of the mold resin 4, the injection state comes to be as illustrated in FIG. 7(*d*). The liquid level IL of the mold resin 4*i* on the inside of the square-shaped structure of the core 9 comes to be equal to the liquid level OL of the mold resin 4*o* on the outside to cover the upper end face 9SU of the core 9 and the uppermost portion of the wire wound part 62 of the coil 6 resulting in the completion of the injection.

As described above, the injection of the mold resin 4 into the reactor 1 according to the second embodiment goes from the state of FIG. 7(*a*), undergoes the state of FIG. 10 and leads to the state of FIG. 7(*d*). As compared with the injection according to the first embodiment that goes from the state of FIG. 7(*a*), undergoes the states of FIGS. 7(*b*) and 7(*c*) and leads to the state of FIG. 7(*d*), the time needed for injection is shortened.

Thus, as described above, according to the second embodiment, since the core 9 is provided with the notch Cc1, coming round performance of the mold resin 4 to the outside of the square-shaped structure of the core 9 can be improved.

As the result, in addition to the advantage of the first embodiment, the time needed for injection can be further shortened and thus manufacturing cost can be reduced still further.

Embodiment 3.

Figure 11:
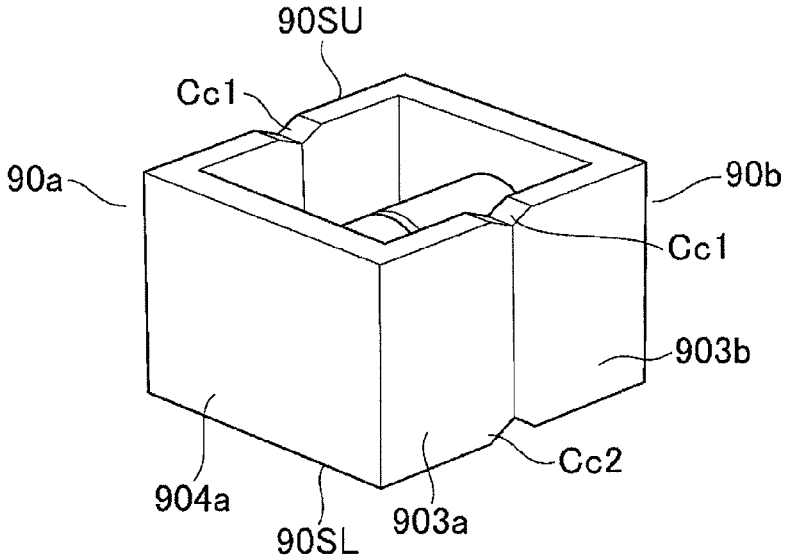
FIG. 11 is a view illustrating an assembled state of a core of a reactor according to a third embodiment of the invention.

With reference to FIG. 11, a third embodiment that is a modification of the reactor 1 according to the second embodiment is hereinafter described. FIG. 11 is a perspective view illustrating an assembled state of cores 90*a* and 90*b* of the induction component 3 of the reactor 1 according to the third embodiment of the invention.

In this third embodiment, the induction component 3 includes cores 90*a*, 90*b* instead of the cores 9*a*, 9*b* in the second embodiment. The columnar part 92*a*, the outer leg part 93*a* and the side end part 94*a* of the core 9*a* in the second embodiment correspond to a columnar part 902*a*, an outer leg part 903*a* and a side end part 904*a* of the core 90*a*, and the columnar part 92*b*, the outer leg part 93*b* and the side end part 94*b* of the core 9*b* in the second embodiment correspond to a columnar part 902*b*, an outer leg part 903*b* and a side end part 904*b* of the core 90*b*.

Furthermore, the outer leg part 93*a* of the core 9*a*, side end part 94*a*, outer leg part 93*b* of the core 9*b*, upper end face 9SU of the side end part 94*b* and lower end face 9SL in the second embodiment correspond to the outer leg part 903*a* and side end part 904*a* of the core 90*a*, and the outer leg part 903*b*, side end part 904*b* of the core 90*b*, upper end face 90SU and lower end face 90SL of the core 904*b*.

In the description hereinafter, the cores 90*a* and 90*b* may inclusively be referred to as a core 90 in some cases.

At the core 90*a*, 90*b*, a part of the upper portion and the lower portion of the abutted face of both outer leg part 903*a* and outer leg part 903*b* is notched, and thus a notch Cc1 which is lower in height than the upper end face 90SU and a notch Cc2 which is higher in height than the lower end face 90SL are formed.

Since the core 90*a* and core 90*b* of the same shape and of the same dimension are used, the notch Cc2, in the same manner as the notch Cc1, is positioned substantially midway between the side end part 904*a* of the core 90*a* and the side end part 904*b* of the core 90*b*.

Accordingly, when the mold resin 4 is injected or poured toward the wire wound part 62 from above the upper central portion of the wire wound part 62 of the coil 6, while being spread into between turns of the wire wound part 62, and the mold resin 4 is charged in the inside surrounded by the square-shaped structure of the core 90 as the mold resin 4*i*, an at the same time, the mold resin 4 flows substantially uniformly as the mold resin 4*o* to outside of the square-shaped structure of the core 90 through the space to be formed between the notch Cc2 and the region sf1 on the inner bottom of the case 2, in addition to the space to be formed between the region sf0 at four corners on the inner bottom of the case 2 and the lower end face 90SL of the core 90.

Thus, even in the case that the viscosity of the mold resin 4 is increased due to higher charge rate of a filler material to be mixed in the mold resin 4 or low temperature of the mold resin 4, or in the case that on the outside of the square-shaped structure of the core 90, the gap with respect to the side wall 21 of the case 2 is narrow and the mold resin 40 is hard to spread into this portion, especially by making larger the flow amount of the mold resin 4 from inside to outside of the square-shaped structure, the time needed for the injection can be shortened.

Incidentally, although in the above-mentioned first, second and third embodiments, a coil in which the cross section of a wire conductor is rectangular, even in the case of a coil of which cross sectional shape is substantially square or circular, the advantage of the invention can be obtained.

In addition, although the one having a magnetic gap G is illustrated, even in the case of the one having no magnetic gap G, the same advantage can be obtained.

Further, although the one in which a magnetic gap G is provided at the columnar part 72 of the core 7 is illustrated, it is preferable that a magnetic gap G is provided at the outer leg parts 73*a*, 73*b*. Moreover, the columnar part of the core is not limited to a cylindrical shape, but may be a prism shape. In this case, a coil is wound in prism tube shape around the perimeter of the prismatic columnar part of the core, and the region sf2 on the inner bottom of the case 2 has no elevation difference of the cylindrical circumference but is planar.

Incidentally, the above-described embodiments are meant to be exemplary preferred examples of the invention, the scope of the invention should not be limited thereto. So long as within the scope of the invention, embodiments with other several shape changes or modifications may be made. For example, although in the first embodiment, the region sf0 on the inner bottom of the case 2 is illustrated to be of a quadrilateral, it is preferable to be any shape of the region extending inside and outside the square-shaped structure of the core.

Furthermore, although the reactor according to the invention is suitable for on-vehicle applications, it is not necessarily for use in an on-vehicle power converter but is applicable to a reactor for other uses.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A reactor comprising:

an induction component comprising:

a coil;

a core in an interior of which a magnetic path is formed; and an insulation bobbin which positions and engages a wire wound part of the coil, is housed in a case, and is to be soaked with a mold resin, wherein an inner bottom face of said case has a plurality of surfaces having different heights with respect to an outside bottom surface of said case being a reference surface, the plurality of surfaces of the inner bottom face of the case comprises a highest surface disposed in a center portion of the case, a lowest inner bottom surface disposed at a periphery of the case, and an intermediate surface which is disposed between the highest surface and the periphery of the case and has a height which is intermediate between heights of the highest surface and the lowest inner bottom surface, with respect to said reference surface, and a lower end face of said core is in contact with any of said plurality of surfaces of the inner bottom face of said case excluding the lowest inner bottom surface disposed at the periphery of the inner bottom face of said case.

2. The reactor according to claim 1, wherein a cross-section of the lower end face of said core in contact with the inner bottom face of said case comprises sides of substantially equal length to form a substantially square-shaped lower end face, the coil of said induction component is positioned inside the substantially square-shaped lower end face of the core, and a plurality of surfaces of a lowest height of the surfaces of said inner bottom face extend inside and outside of said substantially square-shaped lower end face of the core symmetrically about a center of the substantially square-shaped lower end face of the core.

3. The reactor according to claim 1, wherein an insulating member is provided between said insulation bobbin and the inner bottom face of said case, and a part of the wire wound part of the coil is positioned via said insulating member on the highest surface having the height higher than a surface with which the lower end face of said core is in contact.

4. The reactor according to claim 2, wherein an insulating member is provided between said insulation bobbin and the inner bottom face of said case, and a part of the wire wound part of the coil is positioned via said insulating member on the highest surface having the height higher than a surface with which the lower end face of said core is in contact.

5. The reactor according to claim 1, wherein the lower end face of said core is in contact with the intermediate surface having said intermediate height, the wire wound part of said coil is located on said highest surface, and said mold resin is injected on said lowest inner bottom surface.

6. The reactor according to claim 1, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

7. The reactor according to claim 2, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

8. The reactor according to claim 3, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

9. The reactor according to claim 4, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

10. The reactor according to claim 5, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

11. The reactor according to claim 6, wherein a notch is formed at an upper end face of an abutted portion of said two core members so as to extend inside and outside of said core.

12. The reactor according to claim 7, wherein a notch is formed at an upper end face of an abutted portion of said two core members so as to extend inside and outside of said core.

13. The reactor according to claim 6, wherein a notch is formed at a lower end face of an abutted portion of said two core members so as to extend inside and outside of said core.

14. The reactor according to claim 7, wherein a notch is formed at a lower end face of an abutted portion of said two core members so as to extend inside and outside of said core.

15. A reactor comprising:

an induction component comprising:

a coil;

a core in an interior of which a magnetic path is formed; and an insulation bobbin which positions and engages a wire wound part of the coil, is housed in a case, and is to be soaked with a mold resin, wherein an inner bottom face of said case has a plurality of surfaces having not less than two different heights with respect to an outside bottom surface of said case being a reference surface, a lower end face of said core is in contact with any of said surfaces of the inner bottom face of said case excluding a lowest inner bottom surface, the inner bottom face of said case comprises the lowest inner bottom surface, the plurality of surfaces having the different heights comprises a highest surface and a surface having a height which is intermediate between the highest surface and the lowest inner bottom surface, with respect to said reference surface, the lower end face of said core is in contact with the surface having said intermediate height, the wire wound part of said coil is located on said highest surface, said mold resin is injected on said lowest inner bottom surface, a cross-section of the lower end face of said core in contact with the inner bottom face of said case comprises sides of substantially equal length to form a substantially square-shaped lower end face, and said lowest inner bottom surface is formed at four corners of said case and extends inside and outside of said substantially square-shaped lower end face of the core.

16. The reactor according to claim 15, wherein a turn circumference of said coil is cylindrical, and said highest surface has a shape forming a part of an arc so as to be along a circumferential shape of the wire wound part of said coil.

17. The reactor according to claim 15, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

18. The reactor according to claim 16, wherein said core comprises two core members, each comprising:

an end portion having a side end part, an open side opposing the side end part, and a pair of outer leg parts which are abutted to both sides of the side end part to form right angles; and a columnar part which is protruded from an inside of the side end part toward the open side.

* * * * *